US005335612A

United States Patent [19]

Cizek et al.

[11] Patent Number: 5,335,612

[45] Date of Patent: Aug. 9, 1994

[54] ANTI-PUCKER PRESSER FOOT

[75] Inventors: Jaromir Cizek, Port Elizabeth; Stanislaw Galuszynski, Natal, both of South Africa

[73] Assignee: Pathold Investments Company Limited

[21] Appl. No.: 20,667

[22] Filed: Feb. 22, 1993

Related U.S. Application Data

[63] Continuation of Ser. No. 648,594, Jan. 31, 1991, abandoned.

[30] Foreign Application Priority Data

Feb. 2, 1990 [GB] United Kingdom ..... 9002365

[51] Int. Cl.[5] ..... D05B 29/06; D05B 75/00; D05B 35/00

[52] U.S. Cl. ..... 112/262.1; 112/121.26; 112/150; 112/260; 112/235

[58] Field of Search ..... 112/235, 260, 262.1, 112/303, 132, 305, 121.26, 150; 226/195; 26/18.6

[56] References Cited

U.S. PATENT DOCUMENTS

| | | | |
|---|---|---|---|
| 3,613,609 | 10/1971 | Hayes | 112/235 |
| 3,810,280 | 5/1974 | Walton et al. | 26/18.6 |
| 3,933,106 | 1/1976 | Murray | 112/235 |
| 4,649,839 | 3/1987 | Schneckenburger | 112/305 X |
| 4,903,622 | 2/1990 | Frey et al. | 112/305 X |

*Primary Examiner*—Clifford D. Crowder
*Assistant Examiner*—Paul C. Lewis

[57] ABSTRACT

The invention provides a method of and a device for reducing pucker between layers of sheet material during a sewing process wherein an upper layer and a lower layer of material are fed to a stitch formation zone by means of a reciprocating lower feed-dog which engages the lower layer of the material and a first presser foot which overlies the feed-dog and urges the layers of material towards the feed-dog; comprises the steps of tensioning the lower layer of material relative to the upper layer of material in the zone which precedes the stitch formation zone.

21 Claims, 1 Drawing Sheet

ANTI-PUCKER PRESSER FOOT

This is a continuation of application Ser. No. 07/648,594, filed Jan. 31, 1991 now abandoned.

FIELD OF INVENTION

This invention relates to an anti-pucker device for a sewing machine.

BACKGROUND OF INVENTION

Pucker of fabrics which are sewn together for example during the formation of a seam, causes considerable production losses in the clothing goods industry. Where a textile is prone to pucker, a "nip and run" sewing technique which requires considerable operator skill, is normally resorted to. However, re-sewing of seams etc is often necessary. Pucker can result from the following causes:

(i) feed pucker caused by the feed mechanism;

(ii) sewing thread tension pucker produced by contraction of the sewing thread; and (iii) fabric structural jamming pucker caused by fabric structural jamming due to an introduction of sewing thread or needle or both into the fabric during the sewing process.

A number of proposals have been made to reduce seam pucker as caused by the feed mechanism, which can be summarised as follows:

application of rollers to take-up the material during sewing;

application of such feed mechanisms as differential feed, reciprocal feed, compound feed, feeding foot, alternating feed, walking foot, upper and under wheel feed, puller feed;

selecting suitable feed dog teeth. Finer teeth would be more beneficial in reducing pucker;

pressure of presser foot should be kept as low as possible;

the presser foot should just cover the feed area, and be level with it;

direction of sewing should be chosen so as to provide the highest friction between the fabric layers. Generally, sewing in weft direction is recommended;

when sewing different fabrics the fabric with the lower elastic modulus should preferably be the bottom fabric;

application of a sewing aid known as "Kräusel Stop" comprising a special self adhesive tape attached to a sewing machine which has a braking effect on the lower fabric;

use of the "nip and run" technique of sewing. This technique involves the operator nipping the fabrics in front and behind the presser foot and then allowing the firmly gripped seam to move forward in synchronisation with the feeding action of the machine. The seam must not be pulled through the machine or retarded in any way.

None of the above proposals are entirely satisfactory.

OBJECT OF THE INVENTION

It is accordingly an object of the present invention to provide a novel method and means of eliminating or reducing feed pucker. In addition to eliminating or reducing feed pucker, the invention may also have the effect of reducing sewing thread tension pucker, although this would not be its prime objective.

SUMMARY OF INVENTION

According to the invention, a method of reducing pucker between layers of sheet material during a sewing process, wherein an upper layer and a lower layer of material superimposed on one another are fed to a stitch formation zone by means of a reciprocating lower feed-dog which engages the lower layer of the material and an upper presser foot which overlies the feed-dog and urges the layers of material towards the feed-dog; comprises the steps of tensioning the lower layer of material relative to the upper layer of material in the zone which precedes the stitch formation zone.

Further according to the invention the lower layer is tensioned by providing a retarding surface in advance of the stitch formation zone and urging the lower layer into engagement with such retarding surface. Such retarding surface could be in the nature of a high friction surface and it is envisaged that the lower layer could be urged into engagement with such high friction surface by means of a second presser foot which leads the conventional presser foot of the sewing machine.

Also included within the scope of the invention is an anti-pucker device suitable for use in the method of the invention comprising a retarding surface adapted to be disposed in advance of the stitch formation zone of a sewing machine, such retarding surface acting to tension the lower layer of material to be stitched in advance of the stitch formation zone.

Further according to the invention, where the sewing machine provides a first presser foot adapted to urge material to be sewn into engagement with a reciprocating feed-dog which feeds material past the stitch formation zone of the machine, the device includes a second presser foot which is adapted to urge material into engagement with the retarding surface. In this way the material will be tensioned between the retarding surface and the stitch formation zone.

It is envisaged that the retarding surface will be in the nature of a high friction surface which for example, comprises teeth formations angled in a direction opposite to the direction of feed of the material.

The second presser foot may conveniently be secured to the first presser foot via an arm formation for pivotal movement towards and away from the retarding surface, with adjustable biasing means being provided to vary the pressure exerted by the second presser foot on the material. The biasing means could for example be in the nature of a compression spring which engages a lever projecting laterally from the presser foot arm formation, with the compression of such compression spring being variable.

BRIEF DESCRIPTION OF THE DRAWINGS

In order to more clearly illustrate the invention, an embodiment thereof is described hereunder purely by way of example with reference to the accompanying drawings wherein.

DESCRIPTION OF THE PREFERRED EMBODIMENTS

Figure 1:
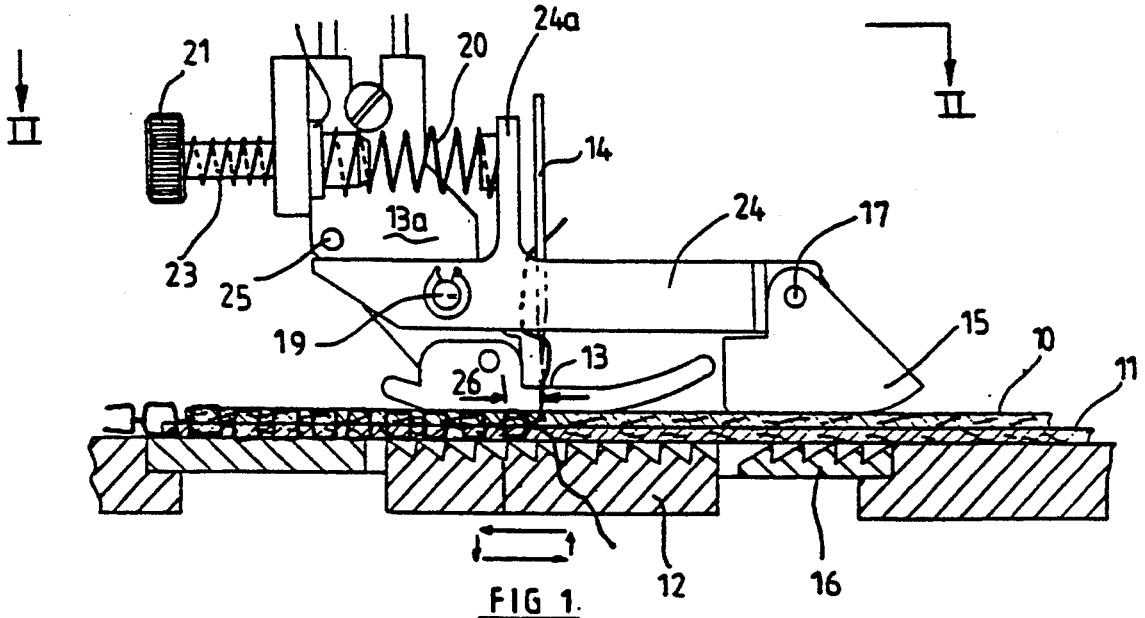
FIG. 1 is a schematic elevation of a sewing machine table including an anti-pucker device in accordance with the invention.
Figure 2:
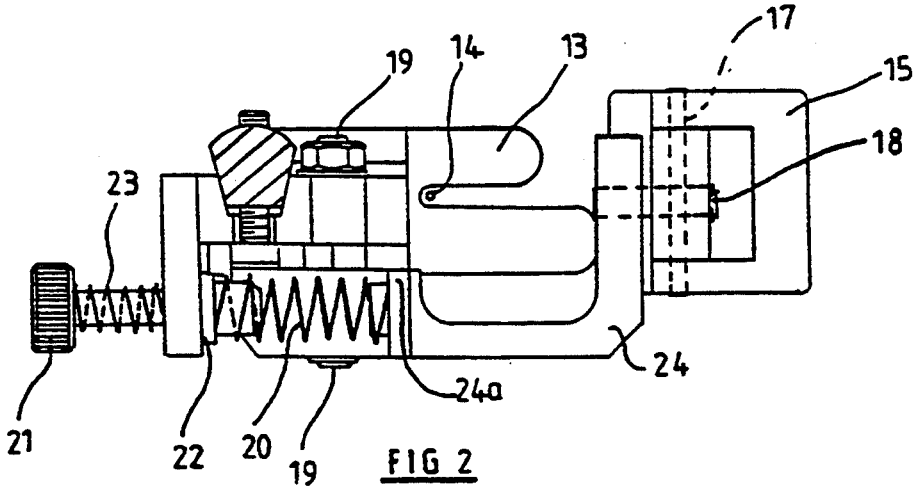
FIG. 2 is a section on line II—II in the machine in FIG. 1.

During a conventional sewing process, a reciprocating log 12 draws material along for stitching purposes, while a first upper presser foot 13 presses layers of material 10 and 11 to be sewn together, for example in the formation of a seam, against the reciprocating dog 12. It has been found that during conventional sewing, greater tension or stretch is created in the upper layer 10 so that upon release of such tension when the material emerges from behind the presser foot 13, the upper layer 10 will contract more than the lower layer 11, causing the latter to wrinkle or pucker.

An anti-pucker device in accordance with the invention comprises a retarding surface 16 disposed on the sewing machine in advance of a stitch formation zone 26, such retarding surface 16 being adapted in use to tension the lower layer 11 of the two layers of material which are to be sewn together. The material 11 is urged onto the retarding surface 16 by means of a second presser foot 15 which presses down on the material layer 10 and hence also on the layer of material 11.

The device of the invention results in an increased tension being set up in the fabric layer 11, so that when the fabric layers 10, 11 emerge from the presser foot 13, equal upstream tension results in equal contraction of these layers, thus eliminating the feed pucker. It has been found that the device of the invention also reduces pucker which results from sewing thread tension. The results of tests conducted with the device of the invention are set out below in Tables 1 to 3:

TABLE 1

EFFECT OF ANTI-PUCKER PRESSER FOOT ON SEAM PUCKER*
INDUSTRIAL SINGLE NEEDLE LOCK STITCH DROP FEED SEWING MACHINE

| | | | FEED PUCKER | | SEWING THREAD TENSION PUCKER | | TOTAL PUCKER | |
|---|---|---|---|---|---|---|---|---|
| NO | TYPE OF FABRIC | FABRIC MASS ($g/m^2$) | Conventional sewing | New sewing** | Conventional sewing | New sewing** | Conventional sewing | New sewing** |
| 1 | Mohair suiting | 183 | 0,500 | 0,094 | 0,363 | 0,360 | 0,863 | 0,454 |
| 2 | Mohair suiting | 189 | 0,591 | 0,046 | 0,454 | 0,454 | 1,045 | 0,500 |
| 3 | Suiting (polyester/viscose) | 200 | 0,364 | 0,046 | 0,545 | 0,363 | 0,909 | 0,409 |
| 4 | Suiting (polyester/viscose) | 250 | 0,409 | 0,091 | 0,545 | 0,363 | 0,954 | 0,454 |
| 5 | Suiting (textured polyester) | 250 | 0,227 | 0,000 | 0,363 | 0,354 | 0,590 | 0,354 |
| 6 | Suiting (all wool) | 254 | 0,727 | 0,046 | 0,409 | 0,272 | 1,136 | 0,318 |
| 7 | Suiting (wool polyester) | 256 | 0,500 | 0,091 | 0,409 | 0,227 | 0,909 | 0,318 |
| 8 | Suiting (textured polyester) | 260 | 0,409 | 0,000 | 0,454 | 0,409 | 0,863 | 0,409 |
| 9 | Suiting (all wool) | 268 | 0,682 | 0,136 | 0,590 | 0,454 | 0,273 | 0,590 |
| 10 | Suiting (wool/polyester) | 272 | 0,409 | 0,046 | 0,454 | 0,363 | 0,863 | 0,409 |
| 11 | Blazer (polyester/viscose) | 300 | 0,282 | 0,137 | 0,272 | 0,272 | 0,554 | 0,409 |
| 12 | Blazer (all wool) | 363 | 0,454 | 0,091 | 0,409 | 0,345 | 0,863 | 0,436 |
| 13 | Shirting (wool/cotton/polyester) | 137 | 0,500 | 0,045 | 0,500 | 0,318 | 1,000 | 0,363 |
| 14 | Shirting (wool/cotton/polyester) | 142 | 0,455 | 0,136 | 0,545 | 0,277 | 1,000 | 0,363 |
| 15 | Lining (polyester) | 89 | 0,091 | 0,000 | 0,818 | 0,409 | 0,909 | 0,409 |
| 16 | Lining (acetate) | 109 | 0,281 | 0,136 | 0,909 | 0,809 | 1,090 | 0,945 |
| 17 | Workwear (polyester/cotton) | 180 | 0,409 | 0,227 | 0,500 | 0,409 | 0,909 | 0,636 |
| 18 | Workwear (polyester/cotton) | 182 | 0,545 | 0,091 | 0,500 | 0,318 | 1,045 | 0,409 |
| | Average | | 0,430 | 0,081 | 0,502 | 0,390 | 0,932 | 0,471 |

*The degree of seam pucker is defined by pucker index $$P(\%) = \frac{\text{Fabric length in the seam} - \text{seam length}}{\text{seam length}} \times 100$$

**New sewing = Anti-Pucker Presser Foot was used.

TABLE 2

EFFECT OF ANTI-PUCKER PRESSER FOOT ON SEAM PUCKER (*)
DOMESTIC SINGLE NEEDLE LOCK STITCH DROP FEED SEWING MACHINE

| | | | FEED PUCKER | | SEWING THREAD TENSION PUCKER | | TOTAL PUCKER | |
|---|---|---|---|---|---|---|---|---|
| NO | TYPE OF FABRIC | FABRIC MASS ($g/m^2$) | Conventional sewing | New sewing** | Conventional sewing | New sewing** | Conventional sewing | New sewing** |
| 1 | Mohair suiting | 183 | 0,461 | 0,086 | 0,312 | 0,289 | 0,773 | 0,375 |
| 2 | Mohair suiting | 189 | 0,492 | 0,072 | 0,465 | 0,454 | 0,957 | 0,526 |
| 3 | Suiting (polyester/viscose) | 200 | 0,210 | 0,001 | 0,651 | 0,342 | 0,861 | 0,343 |
| 4 | Suiting (polyester/viscose) | 250 | 0,372 | 0,003 | 0,960 | 0,478 | 1,237 | 0,481 |
| 5 | Suiting (textured polyester) | 250 | 0,241 | 0,001 | 0,412 | 0,379 | 0,653 | 0,380 |
| 6 | Suiting (all wool) | 254 | 0,161 | 0,020 | 0,475 | 0,291 | 1,636 | 0,311 |
| 7 | Suiting (wool polyester) | 256 | 0,460 | 0,084 | 0,512 | 0,412 | 0,972 | 0,496 |
| 8 | Suiting (textured polyester) | 260 | 0,258 | 0,000 | 0,436 | 0,412 | 0,694 | 0,412 |
| 9 | Suiting (all wool) | 268 | 0,741 | 0,096 | 0,621 | 0,423 | 1,362 | 0,519 |
| 10 | Suiting (wool/polyester) | 272 | 0,350 | 0,034 | 0,506 | 0,342 | 0,856 | 0,376 |
| 11 | Blazer (polyester/viscose) | 300 | 0,192 | 0,006 | 0,312 | 0,286 | 0,504 | 0,292 |
| 12 | Blazer (all wool) | 363 | 0,570 | 0,000 | 0,409 | 0,324 | 0,979 | 0,324 |
| 13 | Shirting (wool/cotton/polyester) | 137 | 0,462 | 0,031 | 0,524 | 0,325 | 0,986 | 0,356 |
| 14 | Shirting (wool/cotton/polyester) | 142 | 0,461 | 0,091 | 0,672 | 0,400 | 1,133 | 0,491 |
| 15 | Lining (polyester) | 89 | 0,104 | 0,000 | 0,872 | 0,512 | 0,976 | 0,512 |
| 16 | Lining (acetate) | 109 | 0,191 | 0,080 | 1,020 | 0,789 | 1,211 | 0,869 |
| 17 | Workwear (polyester/cotton) | 180 | 0,346 | 0,102 | 0,610 | 0,418 | 0,956 | 0,520 |
| 18 | Workwear (polyester/cotton) | 182 | 0,551 | 0,094 | 0,595 | 0,400 | 1,146 | 0,494 |
| | Average | | 0,368 | 0,045 | 0,576 | 0,404 | 0,941 | 0,404 |

*The degree of seam pucker is defined by pucker index $$P(\%) = \frac{\text{Fabric length in the seam} - \text{seam length}}{\text{seam length}} \times 100$$

**New sewing = Anti-Pucker Presser Foot was used.

TABLE 3

EFFECT OF ANTI-PUCKER PRESSER FOOT ON SEAM PUCKER*
INDUSTRIAL SINGLE NEEDLE CHAIN STITCH DROP FEED SEWING MACHINE

| NO | TYPE OF FABRIC | FABRIC MASS (g/m²) | FEED PUCKER Conventional sewing | FEED PUCKER New sewing** | SEWING THREAD TENSION PUCKER Conventional sewing | SEWING THREAD TENSION PUCKER New sewing** | TOTAL PUCKER Conventional sewing | TOTAL PUCKER New sewing** |
|---|---|---|---|---|---|---|---|---|
| 1 | Mohair suiting | 183 | 0,270 | 0,021 | 0,086 | 0,060 | 0,356 | 0,081 |
| 2 | Mohair suiting | 189 | 0,245 | 0,002 | 0,068 | 0,030 | 0,313 | 0,032 |
| 3 | Suiting (polyester/viscose) | 200 | 0,182 | 0,000 | 0,000 | 0,000 | 0,182 | 0,000 |
| 4 | Suiting (polyester/viscose) | 250 | 0,290 | 0,012 | 0,000 | 0,000 | 0,290 | 0,012 |
| 5 | Suiting (textured polyester) | 250 | 0,281 | 0,006 | 0,000 | 0,000 | 0,281 | 0,006 |
| 6 | Suiting (all wool) | 254 | 0,360 | 0,017 | 0,000 | 0,000 | 0,360 | 0,017 |
| 7 | Suiting (wool polyester) | 256 | 0,451 | 0,042 | 0,000 | 0,000 | 0,451 | 0,042 |
| 8 | Suiting (textured polyester) | 260 | 0,530 | 0,103 | 0,000 | 0,000 | 0,530 | 0,103 |
| 9 | Suiting (all wool) | 268 | 0,441 | 0,100 | 0,000 | 0,000 | 0,441 | 0,100 |
| 10 | Suiting (wool/polyester) | 272 | 0,361 | 0,090 | 0,000 | 0,000 | 0,361 | 0,090 |
| 11 | Blazer (polyester/viscose) | 300 | 0,260 | 0,041 | 0,000 | 0,000 | 0,260 | 0,041 |
| 12 | Blazer (all wool) | 363 | 0,470 | 0,054 | 0,000 | 0,000 | 0,470 | 0,054 |
| 13 | Shirting (wool/cotton/polyester) | 137 | 0,480 | 0,086 | 0,036 | 0,021 | 0,516 | 0,107 |
| 14 | Shirting (wool/cotton/polyester) | 142 | 0,432 | 0,032 | 0,051 | 0,021 | 0,483 | 0,053 |
| 15 | Lining (polyester) | 89 | 0,100 | 0,000 | 0,042 | 0,001 | 0,142 | 0,001 |
| 16 | Lining (acetate) | 109 | 0,200 | 0,020 | 0,027 | 0,000 | 0,227 | 0,020 |
| 17 | Workwear (polyester/cotton) | 180 | 0,281 | 0,010 | 0,000 | 0,000 | 0,281 | 0,010 |
| 18 | Workwear (polyester/cotton) | 182 | 0,312 | 0,000 | 0,000 | 0,000 | 0,312 | 0,000 |
| | Average | | 0,330 | 0,035 | 0,017 | 0,007 | 0,348 | 0,043 |

*The degree of seam pucker is defined by pucker index $$P(\%) = \frac{\text{Fabric length in the seam} - \text{seam length}}{\text{seam length}} \times 100$$

**New sewing = Anti-Pucker Presser Foot was used.

It will be appreciated that many variations are possible with regard to constructional details. In the example illustrated, the presser foot 15 is universally hinged by means of cross-pins 17 and 18 to an arm member 24 which is in turn pivotally mounted at 19 on a support 13*a* of the first presser foot 13 of the sewing machine. A compression spring 20 engages an upwardly directly lever 24*a* which extends upwardly from the arm 24 so that the spring 20 acts to bias the arm 24 and its associated presser foot 15 towards the retarding surface 16. The biasing force acting on the lever 24, is adjustable by means of an adjusting screw 21 which defines a collar 22 against which the spring 20 abuts. Thus when the screw 21 is tightened, the compression spring 20 will be compressed, increasing the biasing force on the arm 24. Loosening of the screw 21 will decrease the biasing force. It will be noted that spring means 23 is provided to prevent self-loosening of the adjusting screw 21. Preferably pivotal movement of the lever arm 24 will be limited by means of a stop formation 25, so that when the presser foot 13 is raised to locate or remove fabric thereunder, the presser foot 15 will likewise be raised once the arm 24 has pivoted to its full extent. Doubtless many variations of the invention exist without departing from the principles set out in the consistory clauses.

The advantages of the device of the invention will be apparent to persons skilled in the art. These can be summarized as follows:

(1) Improved sewing efficiency and quality;

(2) Less need for sewing operator skill, particularly since use of the "nip and run" technique will no longer be required;

(3) The device of the invention will largely ensure that seams will not have to be re-done due to feed pucker;

(4) Expensive specialised sewing machines will not be required even for the sewing of problematic materials.

We claim:

1. In a method of reducing pucker between layers of sheet material during a sewing process, comprising the steps of:

feeding an upper layer and a lower layer of material to a stitch formation zone substantially only by means of a reciprocating lower feed-dog which engages only the lower layer of the material; and using a first presser foot overlying the feed-dog to urge the layers of material towards the feed-dog, thereby creating greater tension in the upper material layer than in the lower material layer;

the improvement comprising the step of tensioning the lower layer of material relative to the upper layer of material in a tensioning zone which precedes the stitch formation zone by providing a stationary retarding surface in advance of the stitch formation zone; and urging the lower layer into engagement with the retarding surface by means of a second presser foot which is disposed in advance of the first presser foot of the sewing machine, and which urges both the upper and lower layers of material into contact with each other and toward said retarding surface.

2. The method according to claim 1, comprising the step of providing the stationary retarding surface in the form of a stationary friction surface which provides greater friction with the lower material layer than a surface outside said tensioning zone.

3. The method according to claim 1, wherein the second presser foot tensions the upper layer of material between the second presser foot and the lower layer of material; and the lower layer of material is tensioned between the upper layer of material and the retarding surface; greater tension being thereby applied to the lower layer than to the upper layer.

4. In a sewing machine, wherein an upper layer and a lower layer of material are fed to a stitch formation zone substantially only by means of a reciprocating lower feed-dog which engages only the lower layer of the material, and a first presser foot overlying the feed-dog and urging the layers of materail towards the feed-dog, thereby creating greater tension in the upper material layer than in the lower material layer;

the improvement comprising an anti-pucker device for reducing pucker between the upper and lower material layers, comprising:

a stationary retarding surface disposed in advance of the stitch formation zone of a sewing machine, the retarding surface tensioning the lower layer of material to be stitched in a tensioning zone in advance of the stitch formation zone; and a second presser foot which urges material into contact with the retarding surface in advance of the stitch formation zone, and which urges both the upper and lower layers of material into contact with each other and toward said retarding surface.

5. The device according to claim 4 wherein the retarding surface is a friction surface which provides greater friction with the lower material layer than a surface outside said tensioning zone.

6. The device according to claim 4, wherein the second presser foot tensions the upper layer of material between the second presser foot and the lower layer of material; and the lower layer of material is tensioned between the upper layer of material and the retarding surface; greater tension being thereby applied to the lower layer than to the upper layer.

7. In a sewing machine, wherein an upper layer and a lower layer of material are fed to a stitch formation zone substantially only by means of a reciprocating lower feed-dog which engages only the lower layer of the material, and a first presser foot overlying the feed-dog and urging the layers of material towards the feed-dog, thereby creating greater tension in the upper material layer than in the lower material layer;

the improvement comprising an anti-pucker device for reducing pucker between the upper and lower material layers, comprising a stationary retarding surface disposed in advance of the stitch formation zone of a sewing machine, the retarding surface tensioning the lower layer of material to be stitched in advance of the stitch formation zone;

wherein the stationary retarding surface includes tooth-formations angled in a direction opposed to the direction of feed of the material.

8. The improvement according to claim 7, wherein the second presser foot tensions the upper layer of material between the second presser foot and the lower layer of material; and the lower layer of material is tensioned between the upper layer of material and the retarding surface; greater tension being thereby applied to the lower layer than to the upper layer.

9. An anti-pucker device for reducing pucker between layers of sheet material in a sewing machine, wherein an upper layer and a lower layer of material are fed to a stitch formation zone by means of a reciprocating lower feed-dog which engages the lower layer of the material, and a first presser foot which overlies the feed-dog and urges the layers of material towards the feed-dog, comprising:

a stationary retarding surface disposed in advance of the stitch formation zone of the sewing machine, the retarding surface tensioning the lower layer of material to be stitched in advance of the stitch formation zone; and a second presser foot which urges material into contact with the retarding surface in advance of the stitch formation zone, and which urges both the upper and lower layers of material into contact with each other and toward said retarding surface;

wherein the second presser foot is secured to the first presser foot by means of an arm formation for pivotal movement towards and away from the retarding surface.

10. An anti-pucker device for reducing pucker between layers of sheet material in a sewing machine, wherein an upper layer and a lower layer of material are fed to a stitch formation zone by means of a reciprocating lower feed-dog which engages the lower layer of the material, and a first presser foot which overlies the feed-dog and urges the layers of material towards the feed-dog, comprising:

a stationary retarding surface disposed in advance of the stitch formation zone of the sewing machine, the retarding surface tensioning the lower layer of material to be stitched in advance of the stitch formation zone; and a second presser foot which urges material into contact with the retarding surface in advance of the stitch formation zone, and which urges both the upper and lower layers of material into contact with each other and toward said retarding surface;

wherein an adjustable biasing means is provided to act on the second presser foot to vary the pressure exerted by the second presser foot on the material.

11. The device according to claim 10 wherein the biasing means is a compression spring which engages a lever projecting from the second presser foot with the compression of such compression spring being adjustable.

12. In a sewing machine, wherein an upper layer and a lower layer of superimposed material are fed to a stitch formation zone substantially only by means of a reciprocating lower feed-dog which engages only the lower layer of material, thereby creating greater tension in the upper material layer than in the lower material layer;

the improvement comprising an anti-pucker device for reducing pucker between the upper and lower material layers, comprising:

a presser foot which engages the layers of material in a tensioning zone in advance of the stitch formation zone, and which urges both the upper and lower layers of material into contact with each other and toward said retarding surface; and a stationary retarding surface disposed in advance of the stitch formation zone, wherein the presser foot urges the material into contact with the retarding surface.

13. The improvement according to claim 12, wherein the second presser foot tensions the upper layer of material between the second presser foot and the lower layer of material; and the lower layer of material is tensioned between the upper layer of material and the retarding surface; greater tension being thereby applied to the lower layer than to the upper layer.

14. The device according to claim 12 wherein the retarding surface is a friction surface which provides greater friction with the lower material layer than a surface outside said tensioning zone.

15. In a sewing machine, wherein an upper layer and a lower layer of superimposed material are fed to a stitch formation zone substantially only by means of a reciprocating lower feed-dog which engages only the lower layer of material, thereby creating greater tension in the upper material layer than in the lower material layer;

the improvement comprising an anti-pucker device for reducing pucker between the upper and lower material layers, comprising:

a presser foot which engages the layers of material in advance of the stitch formation zone, and which urges both the upper and lower layers of material into contact with each other and toward a stationary retarding surface; and said stationary retarding surface disposed in advance of the stitch formation zone, wherein the presser foot urges the material into contact with the retarding surface;

wherein the retarding surface includes tooth-formations angled in a direction opposed to the direction of feed of the material.

16. The improvement according to claim 15, wherein the second presser foot tensions the upper layer of material between the second presser foot and the lower layer of material; and the lower layer of material is tensioned between the upper layer of material and the retarding surface; greater tension being thereby applied to the lower layer than to the upper layer.

17. The device according to claim 9, wherein the arm formation permits movement of said second presser foot with at least two degrees of freedom with respect to the first presser foot.

18. An anti-pucker device for reducing pucker between layers of sheet material in a sewing machine, wherein an upper layer and a lower layer of superimposed material are fed to a stitch formation zone by means of a reciprocating lower feed-dog, comprising:

a second presser foot which engages the layers of material in advance of the stitch formation zone, and which urges both the upper and lower layers of material into contact with each other and toward a stationary retarding surface;

wherein the second presser foot is secured to a first presser foot by means of an arm formation for pivotal movement towards and away from the retarding surface.

19. The improvement according to claim 18, wherein the arm formation permits movement of said second presser foot with at least two degrees of freedom with respect to the first presser foot.

20. An anti-pucker device for reducing pucker between layers of sheet material in a sewing machine, wherein an upper layer and a lower layer of superimposed material are fed to a stitch formation zone by means of a reciprocating lower feed-dog, comprising:

a presser foot which engages the layers of material in advance of the stitch formation zone, and which urges both the upper and lower layers of material into contact with each other and toward a stationary retarding surface;

wherein an adjustable biasing means is provided to act on the presser foot to vary pressure exerted by the second presser foot on the material.

21. The device according to claim 20 wherein the biasing means is a compression spring which engages a lever projecting from the presser foot with the compression of such compression spring being adjustable.

* * * * *